United States Patent [19]

Vorwerk et al.

[11] Patent Number: 4,498,400

[45] Date of Patent: Feb. 12, 1985

[54] HOPPER SLOPE SHEET SUPPORT AND CONNECTING MEANS

[75] Inventors: Frederick E. Vorwerk, St. Peters; James D. Mundloch, Florissant, both of Mo.

[73] Assignee: ACF Industries, Incorporated, New York, N.Y.

[21] Appl. No.: 429,744

[22] Filed: Sep. 30, 1982

[51] Int. Cl.[3] ..... B61D 5/02; B61D 7/02; B61D 49/00

[52] U.S. Cl. ..... 105/248; 105/358; 105/377; 105/406 R; 105/411; 105/418; 105/424; 298/30

[58] Field of Search ..... 105/238 R, 247, 248, 105/249, 250, 251, 253, 358, 360, 406 R, 413, 414, 415, 416, 417, 418, 419, 420, 424, 377, 411; 298/30

[56] References Cited

U.S. PATENT DOCUMENTS

| | | | |
|---|---|---|---|
| 1,067,784 | 7/1913 | Irwin et al. | 105/248 |
| 1,268,118 | 6/1918 | Hillman | 105/248 |
| 1,365,216 | 1/1921 | Anderson | 105/248 |
| 1,748,139 | 2/1930 | McBride | 105/248 |
| 2,160,450 | 5/1939 | Wine | 105/249 |
| 2,240,670 | 5/1941 | Sanford | 105/418 X |
| 2,989,930 | 6/1961 | Flowers | 105/239 X |
| 3,509,827 | 5/1970 | Sutter | 105/248 |
| 3,577,932 | 5/1971 | Pulcrano et al. | 105/424 |
| 4,230,048 | 10/1980 | Gordon et al. | 105/414 X |
| 4,292,898 | 10/1981 | Gordon et al. | 105/248 X |

FOREIGN PATENT DOCUMENTS

| | | | |
|---|---|---|---|
| 724422 | 8/1980 | U.S.S.R. | 105/424 |

*Primary Examiner*—Robert B. Reeves
*Assistant Examiner*—Howard Beltran
*Attorney, Agent, or Firm*—Polster, Polster and Lucchesi

[57] ABSTRACT

Large metal plates (120) located on each side of a railway hopper car are used to connect the hopper slope sheets (102, 104) to the car body sides (16) and longitudinally extending side sills (112). The large plates are generally "U" shaped and include legs (124, 126) which extend downwardly from the joint between the transverse bulkheads (14) and the slope sheets downwardly along each of the slope sheets. The plates are connected to the car body sides (16) to a smaller side sill reinforcing plate (121) and the side sill (112) with mechanical fasteners (128, 129) such as Huck bolts. The plate includes flange portions (132, 134) extending inwardly from the car body sides containing openings or slots (132, 134) to receive transversely extending reinforcements (140), preferably I beams (142, 142') which reinforce the hopper slope sheets and which are held in place adjacent, but spaced from, the car body sides and side sill with gussets (146) integrally connected to the large plates. Preferably an angle (160) located below the bulkhead slope sheet joint which extends transversely of the car is integrally connected to upper portions of the plate. Clearance (152) is provided between the legs of the plate and the slope sheets and resilient material (154) is located between the legs of the plate and the slope sheets to more evenly distribute loads between the car body sides, side sill, and the hopper slope sheets.

9 Claims, 7 Drawing Figures

HOPPER SLOPE SHEET SUPPORT AND CONNECTING MEANS

BACKGROUND OF THE INVENTION

In application Ser. No. 326,796 filed Dec. 3, 1981, a filament wound fiberglass railway hopper car is disclosed in which transversely extending bulkheads and hopper slope sheets are connected to the sides of the filament wound car body by adhesive bonding. However, impact testing of this construction revealed a tendency for bending moments applied by the bulkheads and the hopper slope sheets to the sides of the car to tear the adhesively bonded joint.

In application Ser. No. 429,745 filed Sept. 30, 1982, a connection is described between the transverse bulkheads and the car body sides which tends to reduce or eliminate the bending moments applied to by transverse bulkheads to the sides from tearing the bulkheads from the car body sides.

OBJECT OF THE INVENTION

The object of the present invention is to provide slope sheet supports for a connection between the hopper slope sheets and filament wound car body sides and side sill which reduces or eliminates the tendency for bending moments applied by the slope sheets to tear the slope sheets from the car sides and side sill.

SUMMARY OF THE INVENTION

In accordance with the present invention, large metal plates located on both sides of the car are used to connect the hopper slope sheets to the car body sides and longitudinally extending side sills. The large plates are generally "U" shaped and include legs which extend downwardly from the joint between the transverse bulkheads and the slope sheets downwardly along each of the slope sheets. The plates are connected to the car body sides, to a smaller side sill closure or reinforcing plate and to the side sill with mechanical fasteners such as Huck bolts.

The large plates include flange portions extending inwardly from the car body sides containing openings or slots to receive transversely extending slope sheet reinforcements, preferably I beams which reinforce the hopper slope sheets and which are held in place adjacent, but spaced from, the car body sides and side sill with gussets integrally connected to the large plate. Preferably an angle located below the bulkhead slope sheet joint which extends transversely of the car is integrally connected to upper portions of the plate.

Clearance is provided between the legs of the plate and the slope sheets and resilient material is located between legs of the plate and the slope sheets to more evenly distribute loads between the car body sides, side sill and the hopper slope sheets.

IN THE DRAWINGS

DESCRIPTION OF PREFERRED EMBODIMENTS

Figure 1:
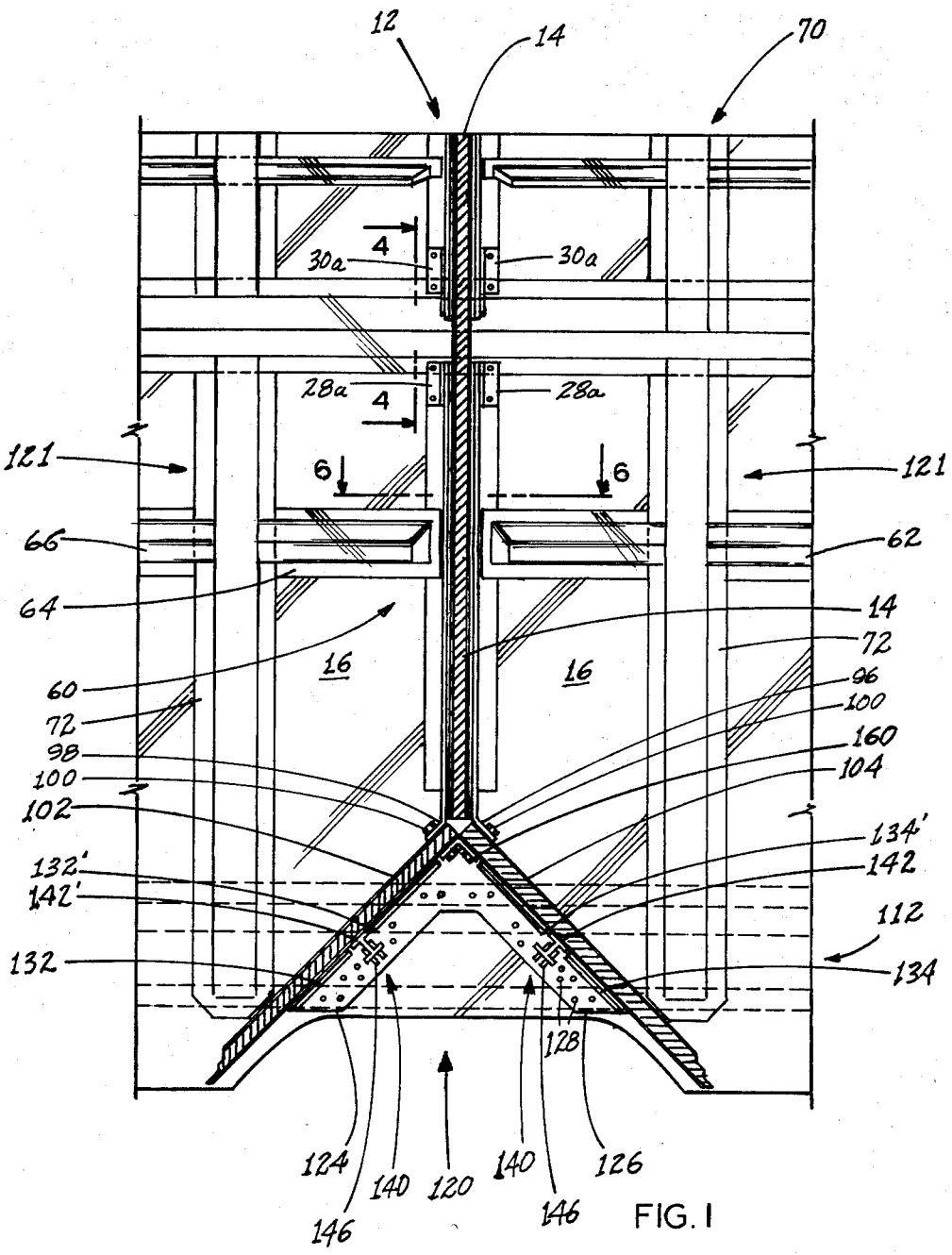
FIG. 1 is a partial side elevation view of a filament wound railway hopper car and illustrates the hopper slope sheet support of the present invention.

In application Serial No. 429,745 filed September 30, 1982, a connection between transverse bulkheads and filament wound car body sides is disclosed. The teachings of this application Serial No. 429,745 filed September 30, 1982, hereby incorporated into this application by this reference.

However, as pointed out in the Background Of The Invention, a difficulty was encountered in that during impact tests the hopper slope sheets tended to apply a bending moment to the car body sides and side sill. This bending moment tended to tear the slope sheets from the sides and side sill. In order to solve this problem, large steel plates 120 are located between hopper slope sheets 102 and 104. These plates 120 are generally "U" shaped and include portions 124 and 126 extending downwardly generally along slope sheets 102 and 104. An upper body portion 122 (FIG. 2) is located below the juncture of hopper slope sheets 102 and 104 and transverse bulkheads 14.

Figure 2:
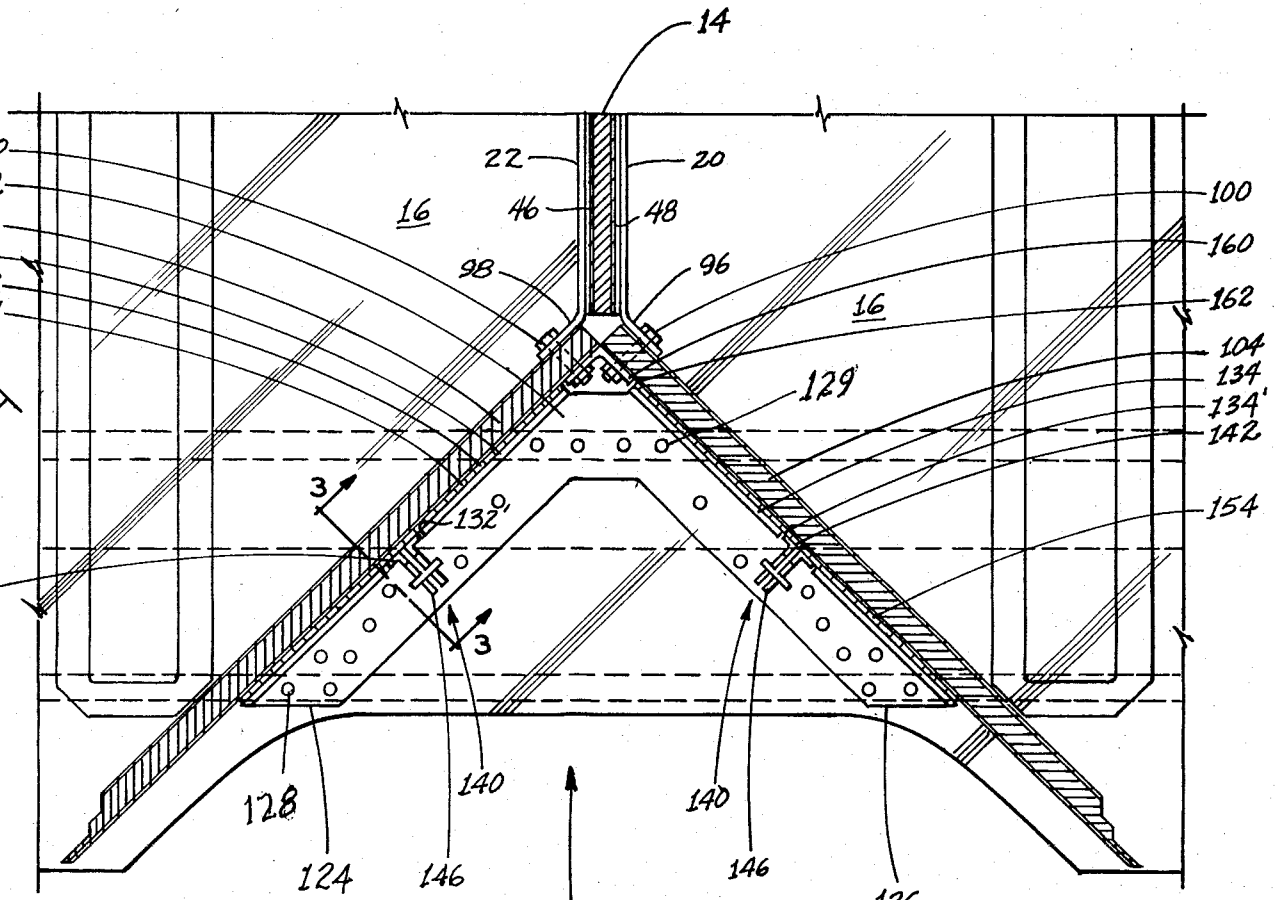
FIG. 2 is an enlarged vertical sectional view illustrating the side sill and steel plate connecting the hopper slope sheets to the car body and to the side sill.
Figure 5:
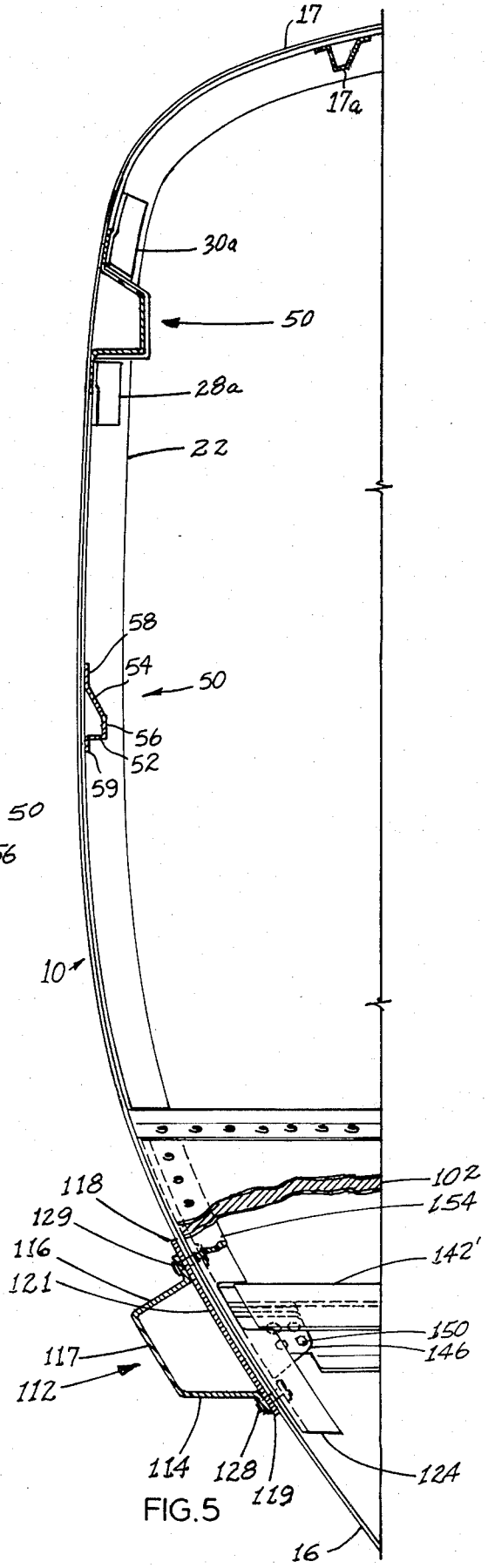
FIG. 5 is a partial side elevation view of a railway hopper car with which the present invention may be utilized.
Figure 6:
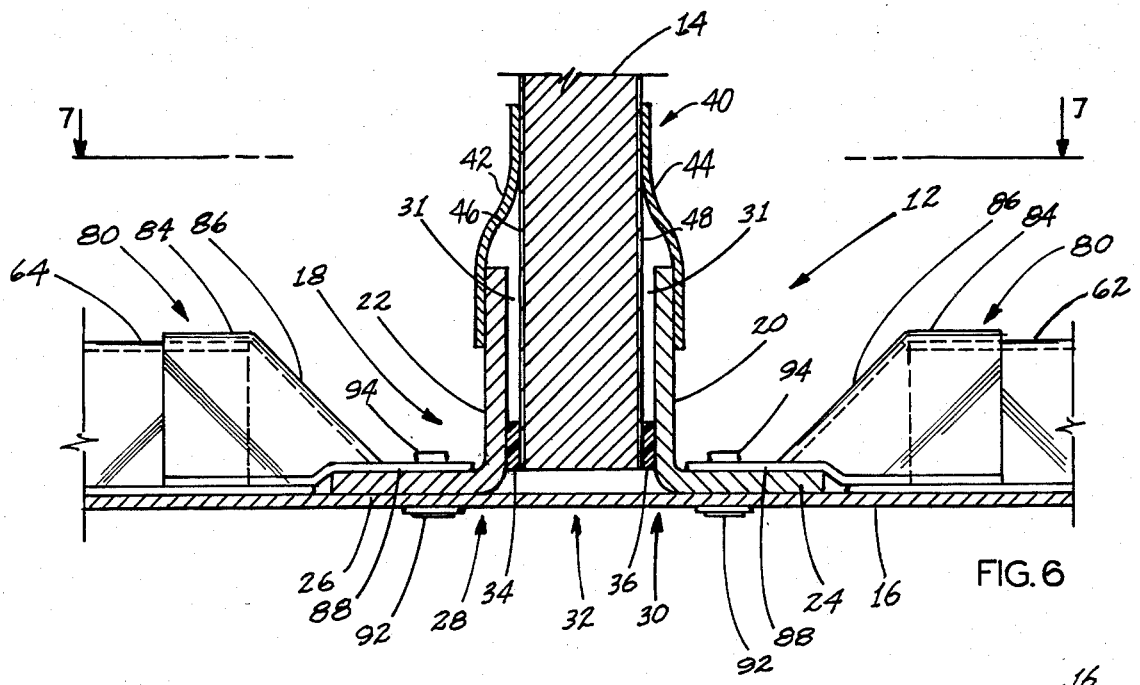
FIG. 6 is a horizontal sectional view looking in the direction of the arrows along the line 6—6 in FIG. 1.

As shown in FIG. 5, the side sill 112 includes outwardly extending portions 114 and 116 joined by a vertical web portion 117. Upper and lower flange portions 118 and 119 are also provided. A side sill closure plate 121 is also provided outboard of the car body 16. In FIGS. 2 and 5, fasteners 128 connect the lower portions of the plate legs 124 and 126 to the side sill closure plate 121 and the side sill flange portion 119. In addition, fasteners 129 connect the upper portion 122 of the large plates to the car body 16 and to the side sill closure plate 121.

In addition, the large plate 120 is provided with flange portions 132 and 134. As shown in FIG. 2, each of the flange portions 132 and 134 include an opening or slot 132; 134' to receive transversely extending slope sheet reinforcing structure indicated generally at 140. These structure preferably comprise light weight structural members such as I beams 142, 142'. These I beams may be made of fiberglass or aluminum. The I beams are of a suitable dimension to provide clearance between their respective ends and the plate 120. The inward extent of flange portions 132 and 134 is sufficient to provide engagement with the I beams and at the same time provide this clearance.

Figure 3:
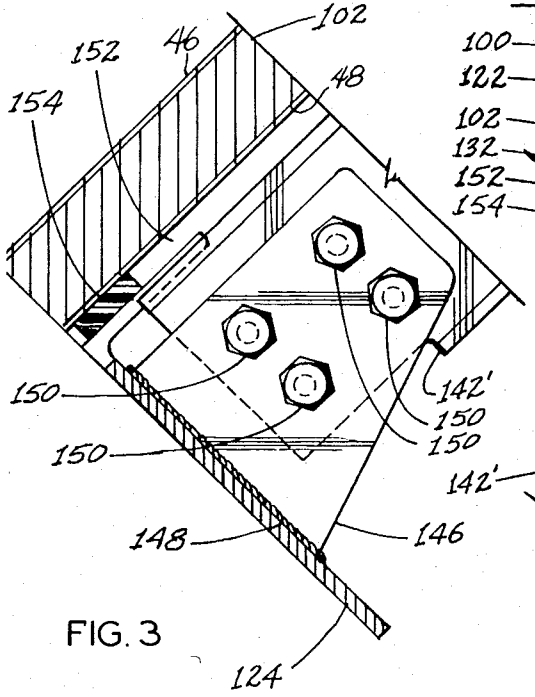
FIG. 3 is an enlarged detail vertical section illustrating the gussets holding the transverse support means in place.

The I beams are held in place by gussets 146 (FIGS. 2 and 3) integrally connected to the portions 124 and 126 of the large plates, for example by welding as indicated at 148 (FIG. 3). Mechanical fasteners 150 hold the gussets 146 in engagement with the I beam.

Clearance indicated at 152 is provided between the hopper slope sheets 104 and 106 and the large plate 120. Resilient material 154 is inserted into this space. Suitable resilient material has a durometer range of 70 to 80 shore A scale. One suitable material is SBR rubber available from Goodyear Tire and Rubber Company located om Akron, Ohio. Resilient material 154 tends to distribute relatively evenly the loads transferred between the hopper slope sheets 102 and 104 and the car body 16 and the side sill 112.

It is thus seen that the transversely extending reinforcing structure 140 tends to reduce or eliminate the tendency of slope sheets 102 and 104 to flex and apply bending load to the car body 16 and the side sill 112. The large plates 120 located on each side of the car and the resilient material 154 tend to react loads applied by the hopper slope sheets 102 and 104 to the side sill. Particularly resilent material 154 tends to more evenly distribute loads to be transferred between the hopper slope sheets 102 and 104 and the side sill 112.

An angle 160 extends transversely of the car and is attached to slope sheets 102 and 104 with fasteners 100. Angle 160 is welded to the upper portion of large plate flange portion 134 as indicated at 162. This steel angle 160 is providing stability for the slope sheets 102 and 104.

As described in greater detail in application 429,745 filed Sept. 30, 1982, a connection assembly 12 is provided between the transverse bulkheads 14 and the car body sides 16. Connection assembly 12 comprises bulkhead support structure indicated generally at 18 which includes a pair of outwardly extending bulkhead support extensions 20 and 22 extending inwardly from the car body wall 16 a distance of, for example, three to ten inches. Extensions 20 and 22 are integrally connected to the car body by means of respective longitudinally extending flange portions 24 and 26. Respective extensions 20 and 22 and flange portions 24 and 26 are conveniently formed in an integral angle indicated respectively in the drawings at 28 and 30. Angles 28 and 30 are formed of suitable light structural material such as fiberglass and aluminum are preferred.

The transverse bulkheads 14 are received within the extensions 20 and 22 on both sides of the car with clearance 31. This clearance is preferably $\frac{1}{4}$ to 1 inch.

Located on both sides of the transverse bulkhead, between the transverse bulkhead and the extensions 20 and 22 are resilient bulkhead cushioning means indicated generally at 32. Resilient bulkhead cushioning 32 comprises a pair of short transversely extending members 34 and 36 made of a resilient material and extending not more than about 2" in from the car body walls 16. The transverse extent of the resilient cushioning means 32 is short to provide a construction whereby bending moments applied by the transverse bulkheads, for example, when the car is impacted are not significantly transmitted to the hopper car wall 16. Thus the tendency to tear the joint between the transverse bulheads and the car body side is substantially reduced or eliminated with the construction of the present invention. Resilient cushioning 32 is preferably applied in strips extending vertically up the car body sides.

Figure 4:
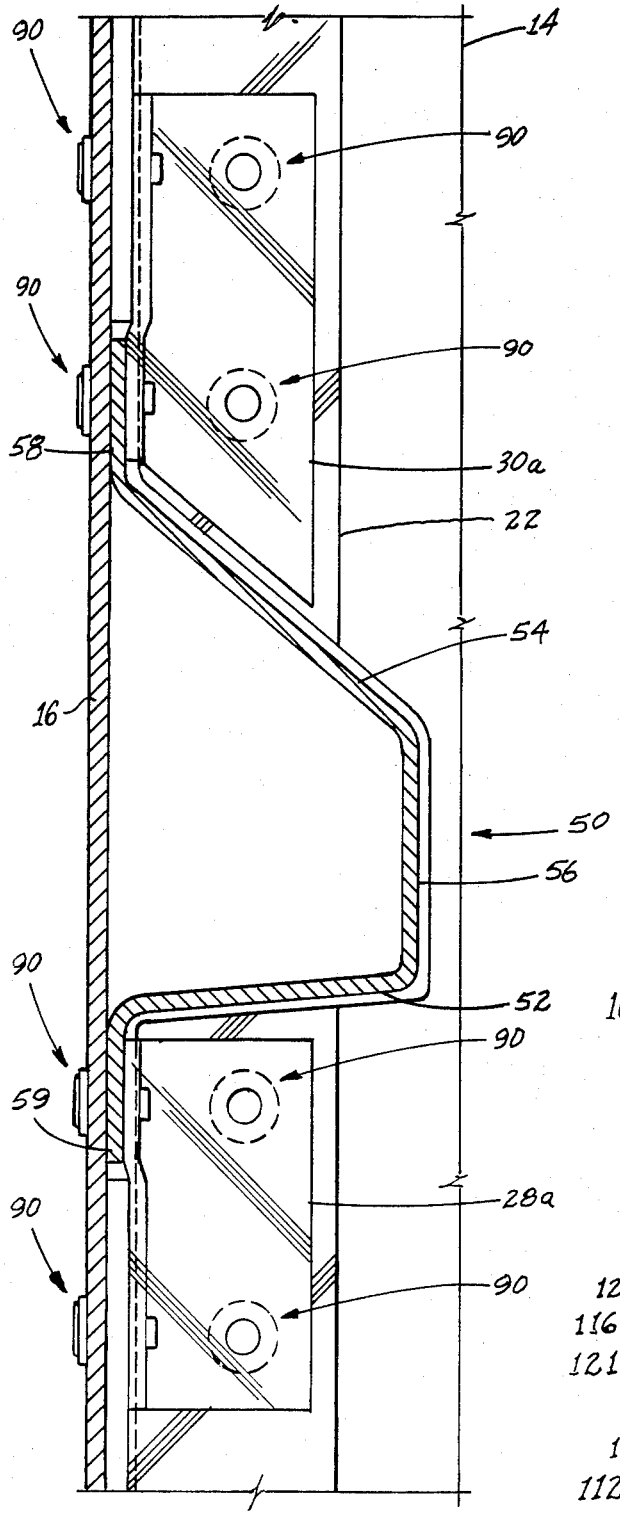
FIG. 4 is a vertical sectional view looking in the direction of the arrows along the line 4—4 in FIG. 1.

Hopper car 10 includes a conventional roof 17 with optional longitudinal stiffeners 17*a* and a top sill 50 (FIG. 5) extending along each side of the car. Top sill 50 includes a pair of webs 52 and 54 joined by a wall portion 56 (FIG. 4). Flange portions 58 and 59 are also provided. Bulkhead support means 18 is discontinuous at the top sill, but is located below and optionally above side plate 50.

In addition, optional connecting structure indicated generally at 40 are provided between the extensions 20 and 22 and the transverse bulkheads 14 to provide a smooth interior surface. Specifically, elastomeric strips 42 and 44 are adhesively bonded to the extensions 20 and 22 and to the transverse bulkhead 14. In one embodiment, vinyl strips are utilized. In general, the transverse bulkhead 14 will be made of wood or wood fibers and will include fiberglass facings 46 and 48 to which the vinyl strips 42 and 44 will respectively be adhesively bonded to.

Figure 7:
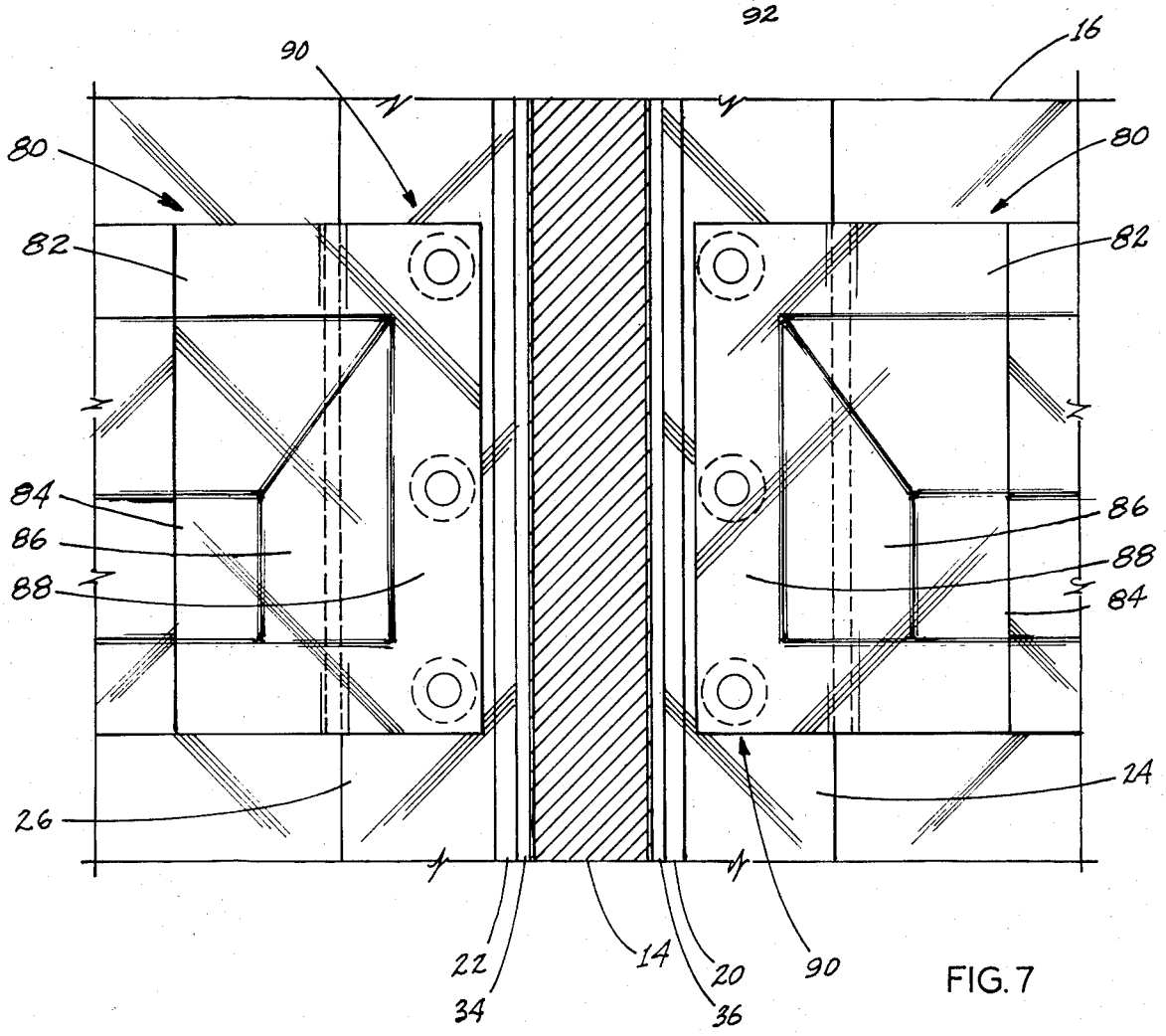
FIG. 7 is a vertical sectional view looking in the direction of the arrows along the line 7—7 in FIG. 6.

The hopper vehicle may include discontinuous longitudinally extending stiffeners indicated generally at 60 and including a series of discrete stiffening members 62, 64 and 66 extending between vertical stiffening structure indicated generally at 70 and including a plurality of long vertical stiffeners 72. As shown in FIGS. 7 and 8, in the area of the bulkhead support 18, the stiffeners 62 and 64 are provided with cap means indicated generally at 80. Cap means 80 include cap members 82 having a body portion 84 which surrounds the stiffener and a transition portion 86 which follows the contour of the stiffener and terminates in a flange portion 88.

Flange portion 88 is connected to flange portions 24 and 26 with suitable fasteners indicated generally at 90. These fasteners 90 are conveniently Huck bolts having head portions 92 and nuts 94. Fasteners 90 also hold in place optional angles 28*a* and 30*a* located above side plate 50. (FIGS. 4 and 5).

At the lower portion of the connector the extensions 20 and 22 extend downwardly as indicated at 96 and 98 in FIG. 2. Fasteners 100 then hold these portions 96 and 98 respectively in engagement with hopper slope sheets 102 and 104 and with angle 160.

What is claimed is:

1. A hopper slope sheet to side sill connection comprising: metal plates located on each side of a filament wound railway hopper car body; said plates connecting transversely extending hopper slope sheets to car body sides and longitudinally extending side sills; said plates being generally "U" shaped and including legs which extend downwardly from a joint between the transverse bulkheads and the slope sheets downwardly along each of the slope sheets; said plates being connected to the car body sides, and to the side sill with mechanical fasteners; said plate including flange portions extending inwardly from the car body sides containing openings to receive transversely extending slope sheet reinforcements.

2. A connection according to claim 1, wherein said reinforcements are held in place adjacent, but spaced from, said large plate with gussets integrally connected to the large plate.

3. A connection according to claim 2, including an angle located below the bulkhead slope sheet joining which extends transversely of the car and is integrally connected on both side of the car to upper portions of the plate.

4. A connection according to claim 1, wherein said transversely extending slope sheet reinforcements are made of light material.

5. A connection according to claim 4, wherein said light material is aluminum.

6. A connection according to claim 4, wherein said slope sheet reinforcements comprise I beams.

7. A connection according to claim 4, wherein said light material is fiberglass.

8. A hopper slope sheet to side sill connection comprising: metal plates located on each side of a filament wound railway hopper car body; said plates connecting transversely extending hopper slope sheets to car body sides and longitudinally extending side sills; said plates being generally "U" shaped and including legs which extend downwardly from a joint between the transverse bulkheads and the slope sheets downwardly along each of the slope sheets; said plates being connected to the car body sides, and to the side sill with mechanical fasteners; said connection including clearance provided between the legs of the plate and the slope sheets; and resilient material located between said legs and said slope sheets to distribute loads between the car body sides, side sill and the hopper slope sheets.

9. A connection according to claim 8, wherein said resilient material to silicone rubber.

* * * * *